US008485760B2

(12) United States Patent
Merrill

(10) Patent No.: US 8,485,760 B2
(45) Date of Patent: Jul. 16, 2013

(54) TIRE GEOREINFORCING SYSTEM

(75) Inventor: Michael J. Merrill, Reno, NV (US)

(73) Assignee: Armaterra, Inc., Reno, NV (US)

( * ) Notice: Subject to any disclaimer, the term of this patent is extended or adjusted under 35 U.S.C. 154(b) by 143 days.

(21) Appl. No.: 13/109,964

(22) Filed: May 17, 2011

(65) Prior Publication Data

US 2011/0280671 A1 Nov. 17, 2011

Related U.S. Application Data

(60) Provisional application No. 61/345,526, filed on May 17, 2010.

(51) Int. Cl.
*E02D 17/20* (2006.01)

(52) U.S. Cl.
USPC ..... 405/302.6; 405/302.4; 405/262; 405/16

(58) Field of Classification Search
USPC ..... 405/262, 284, 285, 286, 302.4, 302.6, 405/15, 16, 17
See application file for complete search history.

(56) References Cited

U.S. PATENT DOCUMENTS

| | | | | |
|---|---|---|---|---|
| 3,421,346 | A | 1/1969 | Wilson | |
| 3,686,173 | A | 8/1972 | Houlihan et al. | |
| 4,045,965 | A | 9/1977 | Vidal | |
| 4,080,793 | A | 3/1978 | Pulsifer | |
| 4,142,821 | A * | 3/1979 | Doring | 405/302.4 |
| 4,150,909 | A * | 4/1979 | Hibarger et al. | 405/27 |
| 4,324,508 | A | 4/1982 | Hilfiker et al. | |
| 4,436,713 | A | 3/1984 | Olson | |
| 4,449,857 | A | 5/1984 | Davis | |
| 4,661,023 | A | 4/1987 | Hilfiker | |
| 4,825,619 | A | 5/1989 | Forsberg | |
| 5,169,266 | A | 12/1992 | Sala et al. | |
| 5,178,489 | A * | 1/1993 | Suhayda | 405/16 |
| 5,364,206 | A | 11/1994 | Marienfeld | |
| 5,378,088 | A * | 1/1995 | Foehrkolb | 405/284 |
| 5,746,545 | A * | 5/1998 | Parker, Jr. | 405/302.6 |
| 5,911,539 | A | 6/1999 | Egan et al. | |
| 6,268,035 | B1 * | 7/2001 | Carpenter | 405/262 |
| 6,375,387 | B1 | 4/2002 | Gabor et al. | |
| 6,443,668 | B1 * | 9/2002 | Streuer et al. | 405/302.6 |
| 6,457,912 | B1 | 10/2002 | Leibl | |
| 6,705,803 | B2 * | 3/2004 | Callinan et al. | 405/16 |
| 6,896,449 | B1 | 5/2005 | Callinan et al. | |
| 7,137,758 | B2 * | 11/2006 | Chou | 405/284 |
| 7,258,326 | B2 * | 8/2007 | Talbott | 405/284 |
| 2003/0156908 | A1 * | 8/2003 | Liaw | 405/284 |
| 2005/0077506 | A1 | 4/2005 | Talbott | |
| 2006/0159526 | A1 * | 7/2006 | Bonasso | 405/284 |
| 2008/0019775 | A1 * | 1/2008 | Johnson et al. | 405/284 |

FOREIGN PATENT DOCUMENTS

JP 2004353430 A 12/2004

OTHER PUBLICATIONS

Forsyth, R.A. "Alternate Earth Reinforcements", ASCE Symposium on Earth Reinforcements, 1978, pp. 350-370.

* cited by examiner

*Primary Examiner* — Frederick L Lagman
(74) *Attorney, Agent, or Firm* — Woodcock Washburn LLP

(57) ABSTRACT

A georeinforcing system, comprising a plurality of georeinforcement elements, each georeinforcement element formed from one or more basic connector pieces having one or more tire treads and one or more tire sidewalls fastened together in an alternating pattern with non-metallic screws. The plurality of georeinforcement elements are attached to a facing element and surrounded in particulate matter to support the facing element.

20 Claims, 28 Drawing Sheets

TIRE GEOREINFORCING SYSTEM

CROSS-REFERENCES TO RELATED APPLICATIONS

This application claims priority to U.S. Provisional Application No. 61/345,526, filed May 17, 2010, which is incorporated herein by reference in its entirety.

BRIEF DESCRIPTION OF THE INVENTION

Embodiments provide improved earth reinforcing (from herein referred to as "georeinforcing") elements that are non-corrosive. Another object of the invention is to provide a configuration for earth reinforcing elements that utilizes friction between the top and bottom of the georeinforcing element and the surrounding particulate matter as well as bearing pressure from the surrounding particulate matter on the forward vertical faces of the georeinforcing element. Yet another object of the invention is to provide improved georeinforcing elements that are stronger than geogrid. A further object of this invention is to provide improved georeinforcing elements that have an economic advantage over other types of earth reinforcing elements. A still further object of this invention is to provide improved georeinforcing elements that can be installed easily. Another object of the invention is to provide improved georeinforcing elements that can be attached to pre-manufactured facing panels, crib wall facing, modular block facing and temporary wall facing. Yet another object of the invention is to provide improved georeinforcing elements that can be attached to an appropriate sloping face to form a reinforced slope. Still another object of the invention is to provide improved georeinforcing elements that divert tires from landfills. Another object of the invention is to provide improved georeinforcing elements that are manufactured from recycled materials. A further object of the invention is to provide improved georeinforcing elements that can be re-used multiple times. Another object of the invention is to provide facing elements for temporary walls and other earth reinforcement structures that can be re-used multiple times. Yet another object of the invention is to provide improved georeinforcing elements that do not require encapsulation in a special (pH neutral) backfill.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Man has planned and constructed earth embankments and retaining walls since the onset of his need to create and construct. Early builders recognized the value of reinforcing the material behind retaining walls to minimize the pressures on those walls. The Babylonians reinforced the soils behind their retaining walls with reeds; the Romans used reeds and papyrus; and the Chinese used sticks and other simple materials in backfilling portions of the Great Wall.

The progress of science brought new technology and new ways of supporting embankments. Reinforced concrete and structural steel became the principal tools in retaining earth; these methods were expensive. As an alternative to large, costly concrete and steel earth retaining structures, the French developed a system known as Reinforced Earth (Vidal, 1969, U.S. Pat. No. 3,421,346), where flat steel straps were used as reinforcing elements. Those elements were buried in the backfill behind a retaining wall facing to provide additional shear and tensile strength to the soil and were connected to the wall facing. Davis (1984, U.S. Pat. No. 4,449,857), continuing earlier work by CalTrans (Forsyth, 1978), developed Retained Earth, using steel rods fashioned in the shape of a ladder as reinforcing elements. Hilfiker (1982, U.S. Pat. No. 4,324,508) developed an earth reinforcing system using welded wire mats as reinforcing elements. These reinforced embankments earned the generic title of mechanically stabilized embankments (MSE's).

The Tensar Corporation developed concurrently high density plastic webbing, now known generically as geogrid, which was used as reinforcing elements in the internal reinforcement of steep fill slopes. Woven fabric geogrids coated with plastic entered the market shortly thereafter. Modular blocks soon became the facing elements of choice for non-highway projects and geogrid became its companion earth reinforcing element (Forsburg, 1989, U.S. Pat. No. 4,825,619), (Miner, 1990, U.S. Pat. No. 4,936,713), (Egan, et al, 1999, U.S. Pat. No. 5,911,539). Geogrid also was combined with L-shaped welded wire basket facings for use in constructing temporary retaining walls and embankments during construction of highway overpass projects, by-pass projects, grade separations and other structures requiring temporary retaining walls or embankments.

Corrosion of steel reinforcing elements buried in soil has long been a concern. Galvanization of the steel was adopted as a preventive measure, then the requirement that the backfill surrounding the steel reinforcing elements consist of a "special" (neutral pH) backfill was added. Later work by Sala et al. (1992, U.S. Pat. No. 5,169,266) and studies by private consultants have revealed a significant potential for corrosion of galvanized steel reinforcing elements buried in special backfill where (1) high alkali soils are present and/or (2) salting and sanding of roads occur above or adjacent to MSE's.

Steel reinforcing elements are considered "non-extensible;" i.e. the modulus of elasticity of the steel reinforcing element is greater than the modulus of elasticity of the surrounding backfill. Conversely, geogrid is considered an "extensible" reinforcing element. The design methodology differs between the two types of reinforcing elements, which results in a greater amount of geogrid required than steel reinforcing for similar MSE's. Thus, the materials cost differential between steel reinforcing elements and geogrid reinforcing elements can be negated by the need for a significantly greater amount of geogrid.

Temporary MSE's, which generally have a life of one to three years, often are demolished and the materials (wire basket facing, geogrid and filter cloth) are hauled to a landfill. The costs of hauling those materials to a landfill can approach the cost of the materials, and filling the landfills with those materials is not an environmentally sensitive choice.

DETAILED DESCRIPTION OF THE INVENTION

One principal object of the present invention is to provide improved earth reinforcing (from herein referred to as "georeinforcing") elements that are non-corrosive. Another object of the invention is to provide a configuration for earth reinforcing elements that utilizes friction between the top and bottom of the georeinforcing element and the surrounding particulate matter as well as bearing pressure from the surrounding particulate matter on the forward vertical faces of the georeinforcing element. Yet another object of the invention is to provide improved georeinforcing elements that are stronger than geogrid. A further object of this invention is to provide improved georeinforcing elements that have an economic advantage over other types of earth reinforcing elements. A still further object of this invention is to provide improved georeinforcing elements that can be installed easily. Another object of the invention is to provide improved georeinforcing elements that can be attached to pre-manufactured facing panels, crib wall facing, modular block facing and temporary wall facing. Yet another object of the invention is to provide improved georeinforcing elements that can be attached to an appropriate sloping face to form a reinforced slope. Still another object of the invention is to provide improved georeinforcing elements that divert tires from landfills. Another object of the invention is to provide improved georeinforcing elements that are manufactured from recycled materials. A further object of the invention is to provide improved georeinforcing elements that can be re-used multiple times. Another object of the invention is to provide facing elements for temporary walls and other earth reinforcement structures that can be re-used multiple times. Yet another object of the invention is to provide improved georeinforcing elements that do not require encapsulation in a special (pH neutral) backfill.

These and other objects of the present invention for georeinforcing elements for stabilizing earth materials and earth structures will become apparent from the following detailed description of various embodiments of the invention in conjunction with the appended drawings.

Figure 1:
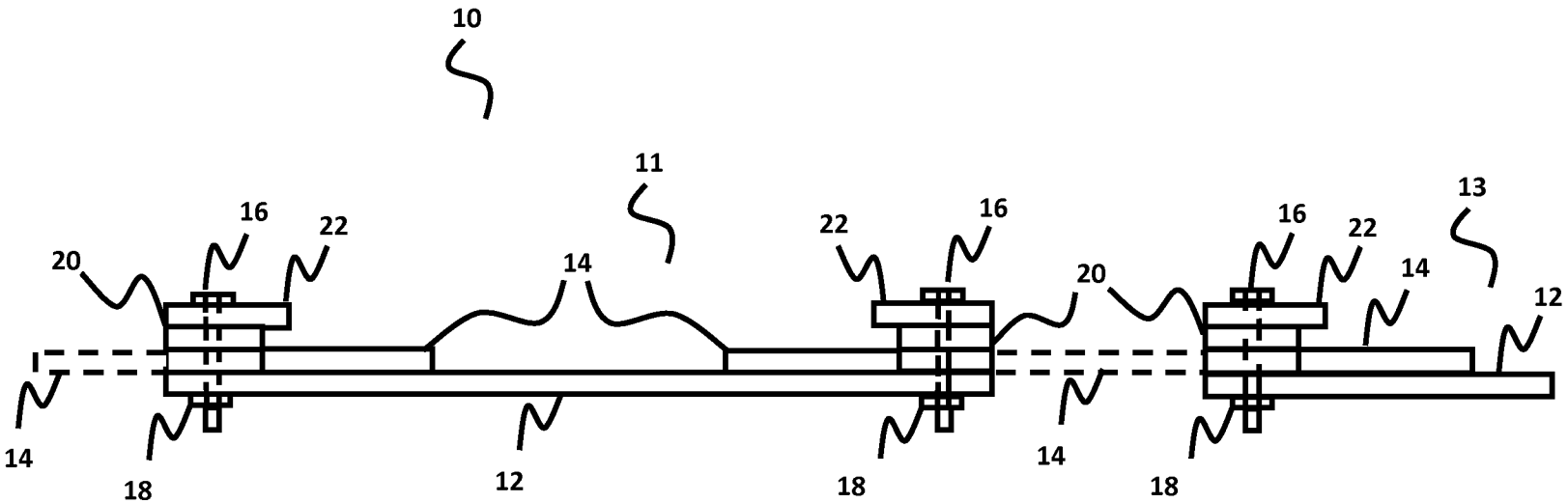
FIG. 1 is a sectional view of a georeinforcing element consisting of a semi-continuous chain of alternating tire treads and tire sidewalls fastened together by means of a series of interlocking tread blocks, tread lips and sidewall combinations.

FIG. 1 is a sectional view of a georeinforcing element 10 consisting of a semi-continuous chain of alternating tire treads and tire sidewalls fastened together with a series of interlocking tread blocks, tread lips and sidewall combinations. Specifically, FIG. 1 illustrates a first basic connector piece 11 and a portion of a second basic connector piece 13 that form the georeinforcing element 10. The georeinforcing element 10 can be made from a plurality of basic connector pieces. The georeinforcing element 10 is manufactured from tires, consisting of a series of basic connector pieces, with each basic connector piece comprised of a tire sidewall 14 linked with a tire tread 12 by means of a series of tread 12/tread block 20/sidewall 14 combinations wherein the inside edge of a sidewall 14 abuts the edge of tread block(s) 20 and is situated above the tire tread 12 and below the tread lip 22. Tread block(s) 20 and tread lip 22 are fastened to tire tread 12 by means of an appropriate number of non-corrosive, non-metallic bolts 16 of an appropriate diameter placed through holes of an appropriate diameter and secured with non-corrosive, non-metallic companion nuts 18. Alternatively, the bolts 16 may be secured with a rubber pad. Embodiments can use a plurality of fastening devices to fasten the tread block and the tread lip to the tire tread, including bolts, screws, and rivets.

Figure 2:
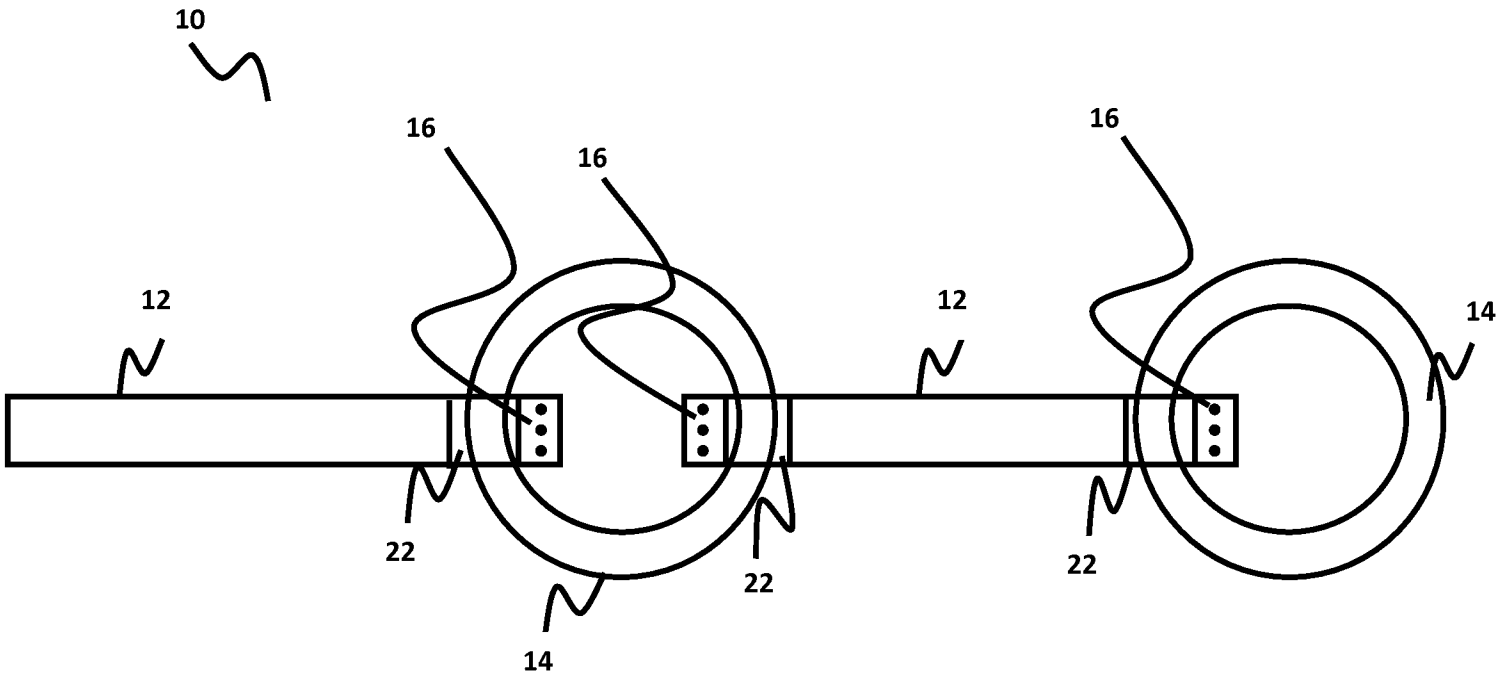
FIG. 2 is a plan view of a georeinforcing element consisting of a semi-continuous chain of alternating tire treads and tire sidewalls fastened together by means of a series of interlocking tread blocks, tread lips and sidewall combinations.
Figure 3:
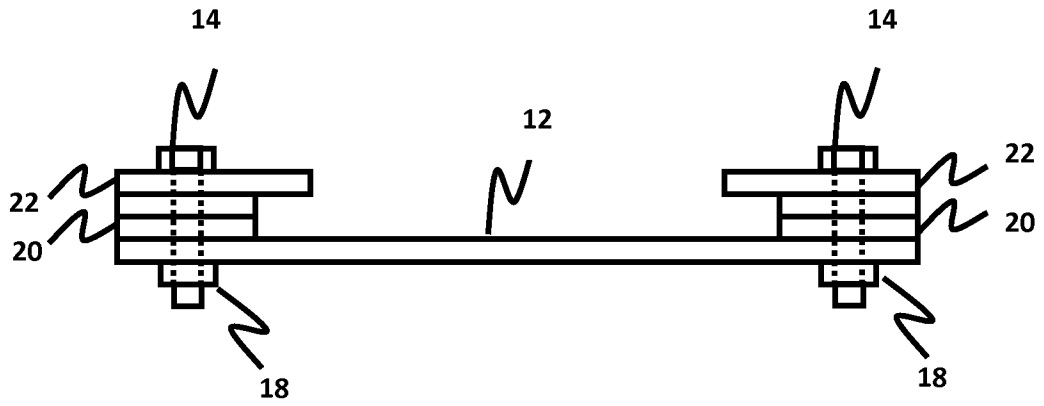
FIG. 3 is a detailed sectional view of a basic connection piece which connects tire sidewalls to tire treads by placement of the inside edge of the sidewall against tread blocks which have been fastened to the tire tread by means of non-corrosive, non-metallic bolts and companion nuts.

FIG. 2 is a plan view of the georeinforcing element 10 consisting of a semi-continuous chain of alternating tire treads 12 and tire sidewalls 14 fastened together by means of a series of interlocking tread blocks, tread lips, and sidewall combinations. FIG. 3 is a detailed sectional view of a basic connector piece for tire georeinforcing element 10. The figure illustrates georeinforcing element 10 which connects tire sidewalls 14 to tire treads 12 by placement of the inside edge of the sidewall 14 (not shown) against tread blocks 20. The tread lip 22, the tread block 20, and the tire tread 12 are fastened together with non-corrosive, non-metallic bolts 16 and companion nuts 18. However, alternative embodiments can use other types of fasteners, including both corrosive and metallic bolts. Examples of non-corrosive and non-metallic fasteners include, but are not limited to, nylon bolts and nuts, nylon rivets, plastic rivets, nylon screws, plastic screws, nylon fasteners, and plastic fasteners.

As indicated above, a plurality of basic connector pieces can be repeated to form a tire georeinforcing element 10 of any desired length. The ends of a tire georeinforcing element 10, consisting of the first basic connector piece and the last basic connector piece in a chain of basic connector pieces, can be sealed with an appropriate corrosion resistant sealer.

Within a tire georeinforcing element 10, the starting basic connector piece (or link) can consist of the tire tread 12 only. Alternatively, the starting basic connector piece can consist of the combination of a tire tread 12, a tread block 20, and a tread lip 22 fastened together with a fastener, other connecting device, or even by a strong adhesive or glue. Similarly, the ending basic connector piece of a tire georeinforcing element 10 can consist of the tire tread 12 only, or it may consist of the combination of a tire tread 12, a tread block 20, and a tread lip 22. The starting basic connector piece and the ending basic connector piece can be different.

In a georeinforcing element 10, the right tread block 20 of a first basic connector piece provides a contact surface area to which a first portion of a first circular tire sidewall 14, connecting the first basic connector with a second basic connector piece, can abut. The left tread block 20 of the second basic connector piece provides a contact surface area to which a second portion of the first tire sidewall 14 can abut, consequently connecting the first basic connector piece with the second basic connector piece. The tread lip 22 projects over the edge of the tread block 20 to prevent the side wall 14 from slipping out and breaking the connection between the first basic connector piece and the second basic connector piece. The right tread block 20 of the second basic connector piece provides a contact surface area to which a first portion of a second circular tire sidewall 14 can abut, connecting the second basic connector piece with a third basic connector piece, and so on.

Embodiments disclosed herein provide an efficient means for recycling and reusing tires. Tires which are no longer suitable for use on vehicles can be reused to create tire georeinforcing elements. Tires are a large and problematic source of waste. Yet, the durability of tires makes them appropriate for georeinforcing elements, while at the same time reducing the amount of tires that end in landfills. The reuse of tires as disclosed herein also enables tires to be reused with minimal manufacturing costs. A tire can be cut along the length of the edges of the tire tread, enabling the two tire sidewalls to be separated from the tire tread that makes contact with the ground. The cutting of the tire in such a fashion results in two tire sidewalls and on a circular tire tread loop. The tire tread loop can subsequently be cut along a line perpendicular to the tire tread loop, enabling the cut tire tread loop to form a substantially rectangular tire tread.

Different types of tires can be used to form tire treads and tire sidewalls of various lengths, widths, and thicknesses. In addition, a georeinforcing element need not be formed from uniform basic connector pieces. A first basic connector piece can be formed from the tire tread and tire sidewalls of a large tire, while a second basic connector piece can be formed from the tire tread and tire sidewalls of a small tire, or vice versa. A basic connector piece also can be formed from the tire treads and tire sidewalls of two different types of tires. For example, within a single basic connector piece, the tire tread can be from a first type of tire, while the tread block or the tire sidewall can be from a second type of tire.

A tire tread block 20 is used to create an elevated contact surface area to which the tire sidewall 14 can abut for connecting a two basic connector pieces. It is to be understood that embodiments are not limited to including a tread block 20 and a tread lip 22 as illustrated in FIGS. 1 and 3. For instance, a first tire tread can be fastened to a first portion of a tire sidewall, while a second portion of the tire sidewall is fastened to a second tire tread, thus effectively creating a connection between the first tire tread and the second tire tread without a tread block 20 and a tread lip 22. The tire sidewall 14 can be turned at an angle so that the inside surface or the outside surface of the tire sidewall 14 faces the tire tread 12, thus providing a large contact surface between the tire tread and the sidewall. The tire sidewall and the tire tread can subsequently be fastened to each other with an attachment device or fastener, such as a bolt. It is also to be understood that while it is preferable to use non-metallic and non-corrosive fasteners, embodiments can use metallic or corrosive fasteners. Embodiments of tire georeinforcing elements can also comprise a tread block 20, but not include a tread lip 22. For instance, the sidewall can be fastened to both the tire tread 12 and to the tread block 20, without requiring the tread lip 22.

Tread blocks 20 can be formed by cutting a tire tread into substantially rectangular segments, and stacking a plurality of such rectangular segments to form a block. For instance, once the tire has been cut to yield the two tire sidewalls and the tire tread, the tire tread can be cut into smaller tire tread segments depending on the required tread block size. These smaller tire tread segments can then be stacked on top of each other, with the number of smaller tire tread segments used depending on the required dimensions of the tread block. If the tread block needed to be 30 centimeters high, and each cut tire tread segment had a height of 10 centimeters, then three tire tread segments could be stacked together to form a tread block 30 centimeters high. A tread lip 22 can be formed similarly to a tread block 20, but the tread lip 22 is to have slightly longer dimensions than the tread block 20, enabling the tread lip to project over the edge of the tread block 20 as illustrated in FIG. 1, thus forming a lip. The tread lip can consist of a single smaller tire tread segment cut from a tire tread. Alternatively, one or more smaller tire tread segments can be stacked vertically to form a taller tire tread lip. The height of the tread lip can be varied by stacking vertically a plurality of smaller tire tread segments, while the length of the tread lip can be varied by choosing smaller or larger tire tread segments that are at least slightly larger than the corresponding tire tread block.

Embodiments disclosed herein also have the advantage of being able to be assembled in the field, rather than having to be assembled and manufactured at a facility, and subsequently transported to the field. In embodiments, a plurality of tires can be transported to the field, and subsequently cut in the field, resulting in a plurality of tire sidewalls and tire treads. The plurality of tire sidewalls and the plurality of tire treads can then be formed into basic connector pieces and the basic connector pieces fastened to form a plurality of georeinforcing elements. Alternatively, a plurality of tire sidewalls and tire treads can be transported to the field, with the assembly of the basic connector pieces performed on the field. In yet another embodiment, a plurality basic connector pieces can be assembled at a facility, with the plurality of basic connector pieces subsequently transported to the field, and connected in the field to form a plurality of georeinforcing elements.

In an embodiment, basic connector pieces can be assembled with the same orientation or with alternating orientations. For instance, a first basic connector piece can have a first orientation, oriented such that the tire tread is positioned on the bottom and the tread block and tread lip are positioned on top. A second connector piece can be connected to the first basic connector piece with a second orientation that is opposite to the first orientation, with the tire tread positioned on top and the tread block and tread lip positioned on the bottom. Thus, in such an embodiment, each basic connector piece facing up is followed by a basic connector piece facing down. Chains of basic connector pieces can be arranged with orientations in any particular order. For instance, the alternating orientation pattern can be repeated every three basic connector pieces, with the first three basic connector pieces facing up, the next three basic connector pieces facing down, and so on. The alternating orientation pattern can even be done in a random order depending on the requirements. In embodiments with the same orientation, all of the basic connector pieces can face up or face down.

In one embodiment, the tread block and the tread lip of the basic connector pieces can be used as the connecting devices between basic connector pieces. In the embodiment, the combination of the tread block and the tread lip from a first basic connector piece can be used as a hook that engages the tread block and the tread lip from a second basic connector piece. A first basic connector piece can be oriented facing up, with the tire tread on the bottom and the tread block and the tread lip on top. A second basic connector piece can then connected to the first basic connector piece by orienting the second basic connector piece to face down, with the tire tread on the top and the tread block and the tread lip on the bottom. Orienting the basic connector pieces in opposite orientations enables the first tread block and the first tread lip from the first basic connector piece (positioned on top) to engage the second tread block and the second tread lip from the second basic connector piece (positioned on bottom), thus forming a link.

Figure 4:
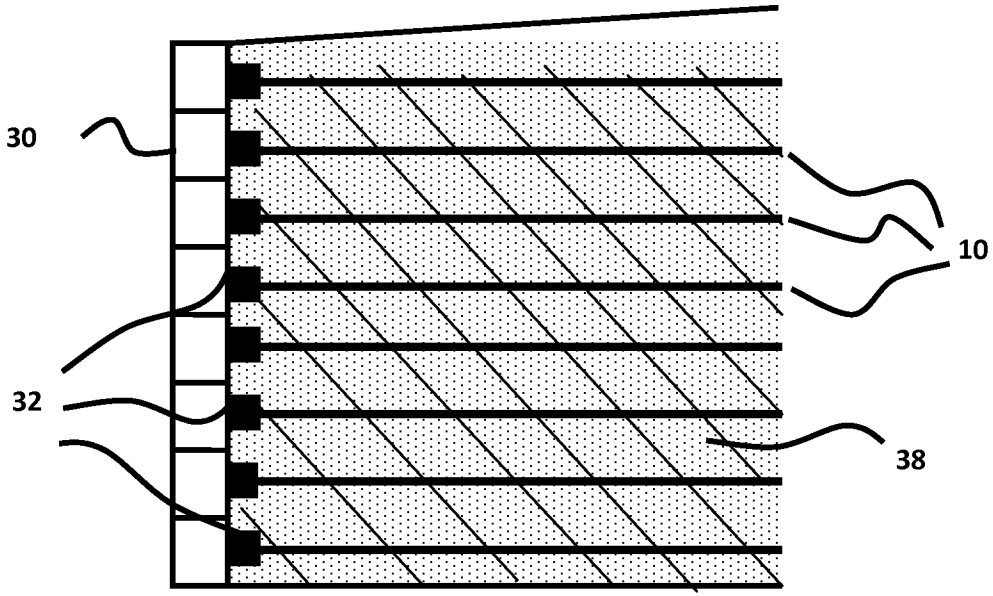
FIG. 4 is a sectional view of a mechanically stabilized embankment utilizing pre-manufactured facing panels of any appropriate size, shape or material connected to tire georeinforcing elements, with each tire reinforcing element surrounded by particulate matter.
Figure 5:
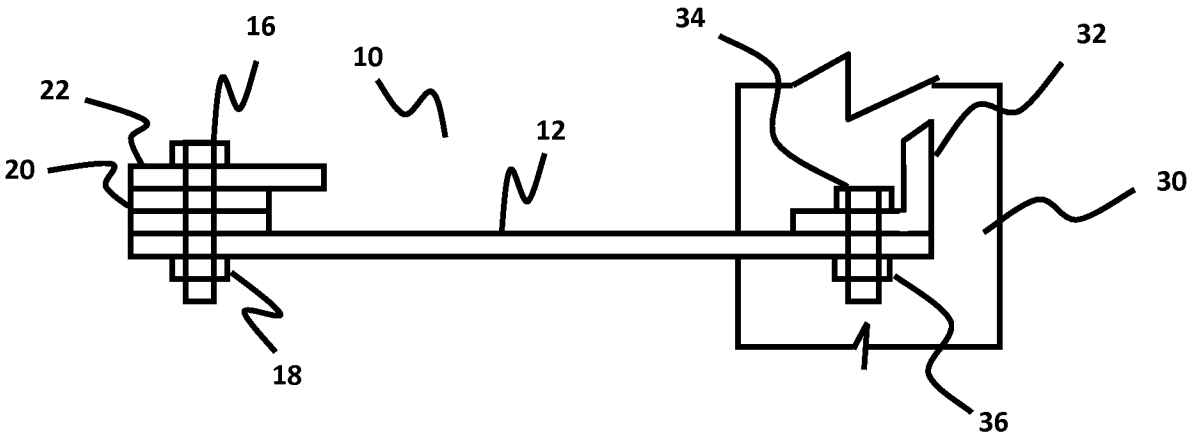
FIG. 5 is a detailed sectional view of a pre-manufactured facing element connected to a tire georeinforcing element by means of a mechanically stabilized embankment connector.

FIG. 4 is a sectional view of a mechanically stabilized embankment utilizing pre-manufactured facing panels connected to tire georeinforcing elements. Each tire reinforcing element is surrounded by particulate matter. In particular, a plurality of tire georeinforcing elements 10 are connected to a pre-manufactured facing panel 30 of any appropriate size, shape or material by means of a connector piece. In an embodiment, the connector piece connects the end of a tire georeinforcing element 10, having a structural steel angle 32 fastened to the tire tread 12, using an appropriate number of structural steel bolts 34 (illustrated in FIG. 5). FIG. 5 is a detailed sectional view of a pre-manufactured facing element 30 connected to a tire georeinforcing element 10 by means of a MSE connector.

FIG. 4 illustrates eight tire georeinforcing elements 10, but any number of georeinforcing elements 10 can be used depending on the environmental conditions, soil conditions, and other project requirements. The steel bolts 34 are placed through holes of appropriate diameter in the structural steel angle 32 and in the tire tread 12 and secured with structural steel companion nuts 36. The structural steel angle 32 and the corresponding end of the tire tread 12 are completely enveloped in the facing panel 30. The plurality of georeinforcing elements 10 are embedded in particulate matter 38.

The georeinforcing elements 10 illustrated in FIG. 4 can vary in size. For instance, the top georeinforcing element can be comprised of four basic connector pieces, while the following georeinforcing element can be comprised of six basic connector pieces. In addition, embodiments are not limited to using structural steel angles 32 and structural steel bolts 34 for fastening each georeinforcing element 10 to the facing panel 30. Embodiments disclosed herein can use other fastening devices or attachment mechanisms for securing each georeinforcing element 10 to the facing panel 30.

Figure 6:
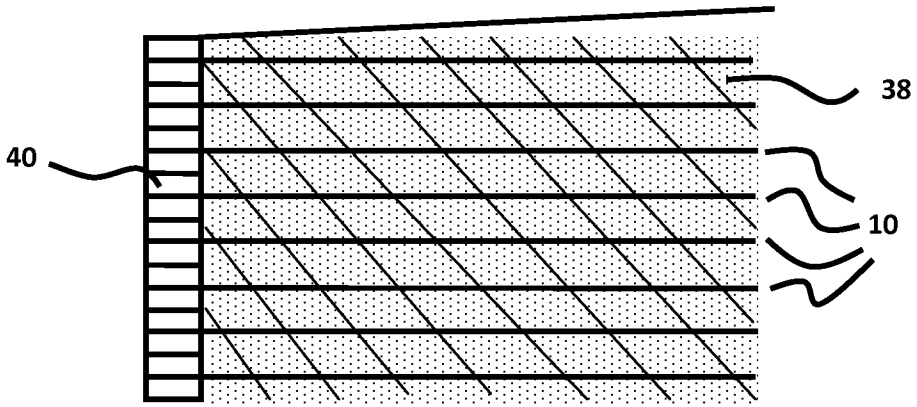
FIG. 6 is a sectional view of a mechanically stabilized embankment utilizing pre-manufactured modular blocks as facing elements connected to tire georeinforcing elements, with each tire georeinforcing element surrounded by particulate matter.
Figure 7:
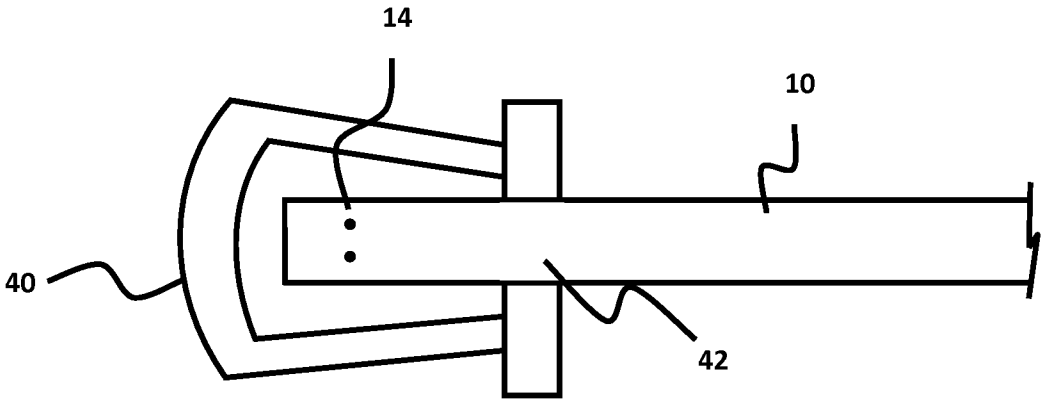
FIG. 7 is a plan view of a hollow core modular block facing element attached to a tire georeinforcing element by means of placing the looped front end of the tire georeinforcing element in the hollow core of the modular block facing element and placing particulate matter in the hollow core of the modular block facing element and around the looped front end of the tire georeinforcing element.
Figure 8:
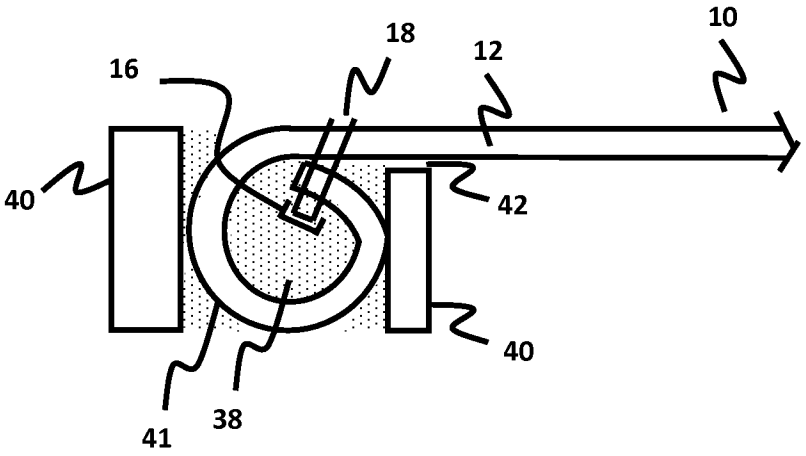
FIG. 8 is a sectional view of the hollow core modular block facing element from FIG. 7.
Figure 9:
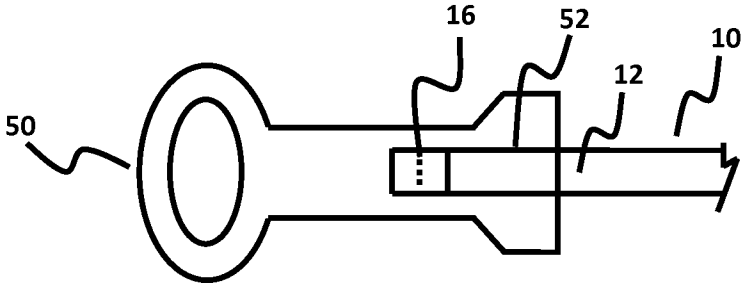
FIG. 9 is a plan view of a solid core modular block facing element attached to a tire georeinforcing element by means of tread blocks affixed to the bottom of the free end of a tire georeinforcing element, with the tread blocks and the free end of the tire georeinforcing element both resting in a pre-manufactured recess in the modular block facing element.
Figure 10:
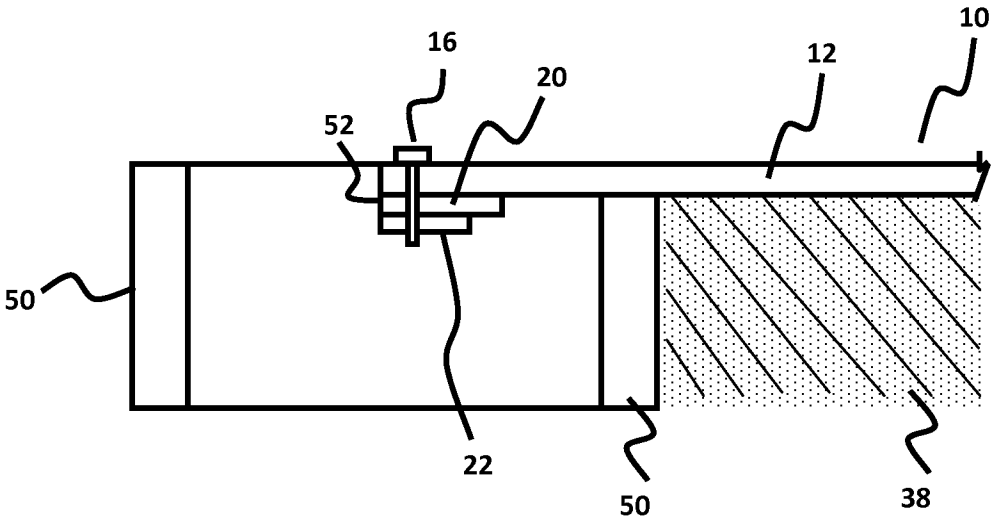
FIG. 10 is a sectional view of the solid core modular block facing element from FIG. 9.

FIG. 6 is a sectional view of a mechanically stabilized embankment utilizing pre-manufactured modular blocks 40 as facing elements connected to tire georeinforcing elements 10. Each tire georeinforcing element 10 is surrounded by particulate matter 38. Examples of modular block facing elements 40 include hollow core modular bocks and solid core modular blocks. FIGS. 7 and 8 illustrate hollow core modular blocks and FIGS. 9 and 10 illustrate solid core modular blocks.

FIG. 7 is a plan view of a hollow core modular block 40, used as a facing element, attached to a tire georeinforcing element 10 by means of placing the looped front end of the tire georeinforcing element in the hollow core of the modular block facing element. After the looped front of the georeinforcing element 10 is inserted in the hollow core modular block 40, particulate matter is added to the hollow core of the modular block facing element and around the looped front end of the tire georeinforcing element 10. In the embodiment, a tire georeinforcing element 10 of any length connects to a hollow core modular block facing element 40 by means of looping the free end of the tire tread 12 portion of the tire georeinforcing element 10 so that it fits into the hollow core modular block facing element 40.

FIG. 8 is a sectional view of the hollow core modular block 40 from FIG. 7. FIG. 8 illustrates the loop 41 in the free end of the tire tread 12 portion of the tire georeinforcing element 10 formed by bending the free end of the tire tread 12 portion of the tire georeinforcing element 10 back and under the main portion of the tire tread 12, and fastening together the looped end with the main portion of the tire tread 12 using a fastener, such as non-metallic bolt 16 and secured with a companion nut 18. A recess 42 is field-cut in the back of the hollow core modular block facing element 40 to accommodate the tire tread 12 portion of the tire georeinforcing element 10. The looped end of the tire georeinforcing element 10 is placed into the hollow core modular block facing element 40 and the hollow core modular block facing element 40 is backfilled with particulate matter 38.

Still another embodiment of the invention contemplates a tire georeinforcing element of any length which connects to a solid core modular block facing element by means of tread blocks affixed to the bottom of the free end of a tire georeinforcing element. The tread blocks and the free end of the tire georeinforcing element both rest in a pre-manufactured recess in the modular block facing element. FIG. 9 is a plan view of a solid core modular block facing element 50, attached to a tire georeinforcing element 10, and FIG. 10 is a sectional view of the solid core modular block facing element 50 from FIG. 9. The georeinforcing element 10 is connected to the solid core modular block 50 by placing the free end of the tire tread of georeinforcing element 10 into a recess 52 in the solid core modular block facing element 50. The recess 52 in the solid core modular block facing element 50 is part of the pre-manufactured solid core modular block facing element 50. An appropriate number of tread blocks 20 are attached to the free end of the tire tread 12 of the georeinforcing element 10. The tread blocks 20 can be attached to the tire tread 12 using a plurality of fastener or other attachment devices. In FIG. 10, non-corrosive and non-metallic bolts 16 are placed through holes of appropriate diameter through the free end of the tire tread 12 of the tire georeinforcing element 10 and into the tread blocks 20 and secured by non-corrosive, non-metallic companion nuts (not shown). Only the area outside of the solid core modular block 50 and surrounding the tire georeinforcing element 10 is embedded in particulate matter 38. In FIG. 10, the free end of the tire tread 12 also includes a tread lip 22. However, alternative embodiments may comprise of only tread blocks 20 attached to the bottom of the tire tread, or alternatively only a tread lip 22 attached to the bottom of the tire tread.

Figure 11:
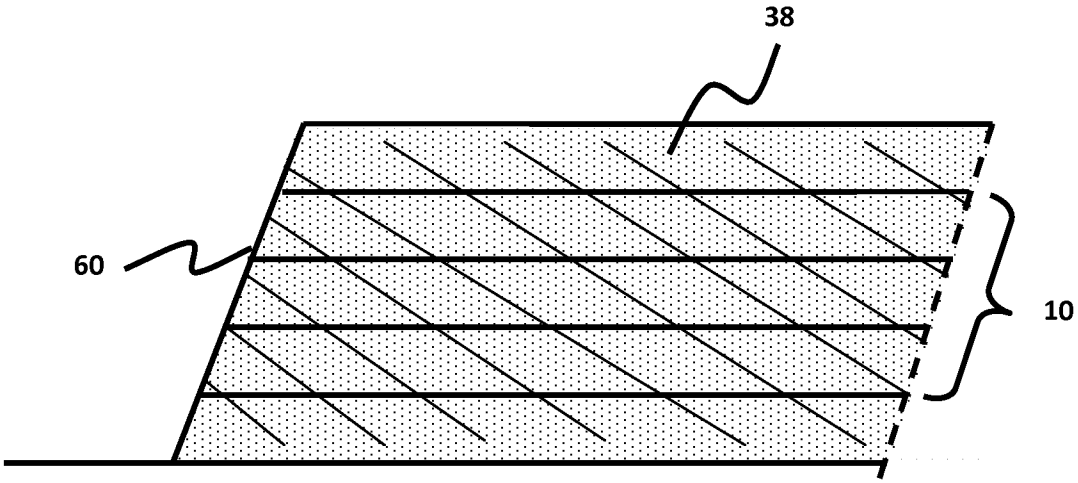
FIG. 11 is a sectional view of a slope comprised of particulate matter reinforced with tire georeinforcing elements buried in the particulate matter, with the front ends of the tire georeinforcing elements connected to a net or mat of geogrid forming a face to contain the particulate matter.

A further embodiment of the invention contemplates an embankment constructed of particulate matter, with a sloping embankment face, reinforced by means of an appropriate number of tire georeinforcing elements placed in the particulate matter and attached to a net or mat of geogrid. FIG. 11 is a sectional view of a slope comprised of particulate matter 38 reinforced with tire georeinforcing elements 10 buried in the particulate matter 38. The front ends of the tire georeinforcing elements 10 are connected to a net or mat of geogrid 60 which forms a face to contain the particulate matter 38.

The net or mat of geogrid 60 covers the sloping face of the particulate matter 38 embankment and is attached to the free ends of tire georeinforcing elements 10 by means of a non-corrosive hook 62 of any appropriate size, shape or material advanced through the free end of each of the tire georeinforcing elements 10 and secured by a non-corrosive, non-metallic companion nut. As indicated above, an alternative fastener, such as a screw or a bolt, can be used in place of the hook 62. In addition, while a non-metallic and a non-corrosive fastener is preferred, alternative embodiments can use metallic and even corrosive fasteners.

Figure 12:
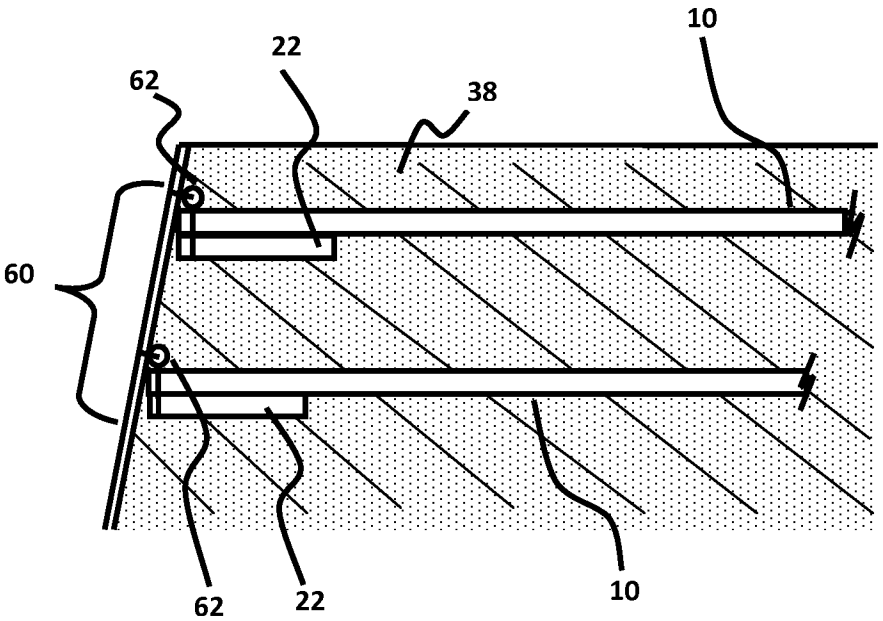
FIG. 12 is a detailed sectional view of a connection between a tire georeinforcing element embedded in particulate matter and a geogrid covering the face of the slope of the particulate matter.
Figure 13:
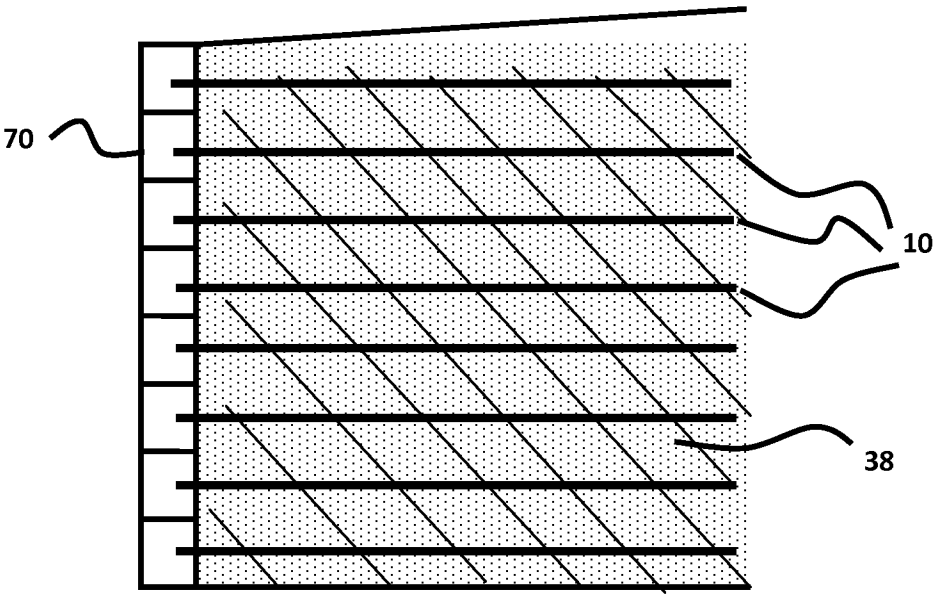
FIG. 13 is a sectional view of a mechanically stabilized embankment utilizing crib walls as a facing element attached to tire georeinforcing elements.

FIG. 12 is a detailed sectional view of a connection between a tire georeinforcing element 10 embedded in particulate matter 38 and geogrid 60 covering the face of the slope of the particulate matter 38. The non-corrosive hook 62, of any appropriate size or shape, is affixed to the end of each of the tire georeinforcing elements 10 and it is used to fasten the front end of each tire georeinforcing element 10 to the geogrid net or mat 60 covering the face of the particulate matter slope above and below the front end of the tire georeinforcing element 10. When using the georeinforcing element 10 to support the geogrid 60, the leading end of the georeinforcing element 10 that comes in contact with the geogrid 60 can consist of only the tire tread 12, the tire tread 12 and tread block 20, tire tread 12 and tread lip 22, or tire tread 12 and tread block 20/tread lip 22.

Figure 14:
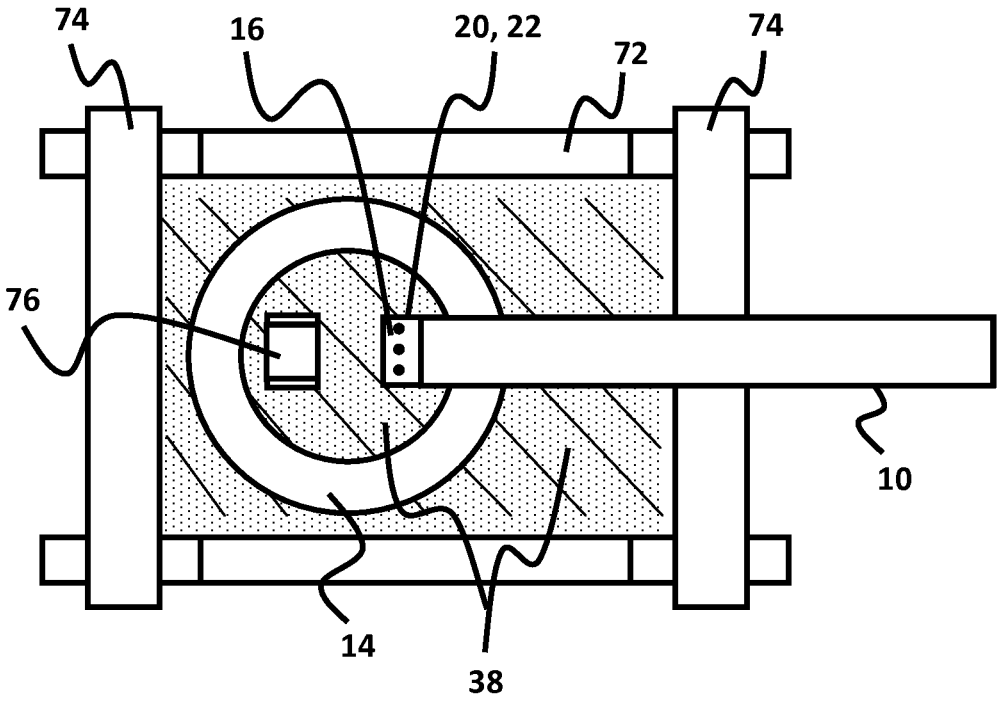
FIG. 14 is a detailed plan view of a crib wall attached to a tire georeinforcing element by means of burying the sidewall end of a tire georeinforcing element in the particulate matter backfill within the crib wall. A buried vertical element is located in the crib wall particulate matter backfill inside the sidewall of the tire georeinforcing element to anchor the tire georeinforcing element to the crib wall facing.

A still further embodiment of the invention contemplates a tire georeinforcing element of any length which connects to a crib wall facing to provide a mechanically stabilized embankment. FIG. 14 is a detailed plan view of a crib wall 70 attached to a tire georeinforcing element 10 by means of burying the sidewall end of a tire georeinforcing element in the particulate matter 38 backfill within the crib wall 70. A crib wall facing 70 consists of manufactured headers 72 and stretchers 74 stacked cross-ways upon each other to form a rectangular box which is backfilled with particulate matter 38. The tire sidewall 14 portion of a tire georeinforcing element 10 becomes the free end of the tire georeinforcing element 10 and is placed in the crib wall facing 70 at regular horizontal and vertical intervals as construction of the crib wall facing 70 progresses. A stretcher 76 is buried in the vertical position and is positioned such that the inside edge of the tire sidewall 14 portion of the tire georeinforcing element 10 bears against the front portion of the vertical buried stretcher 76. The crib wall facing 70 and tire georeinforcing element 10 are then backfilled with particulate matter 38. The stretcher 76 anchors the tire georeinforcing element within the particular matter 38 used to backfill the crib wall facing 70.

Figure 15:
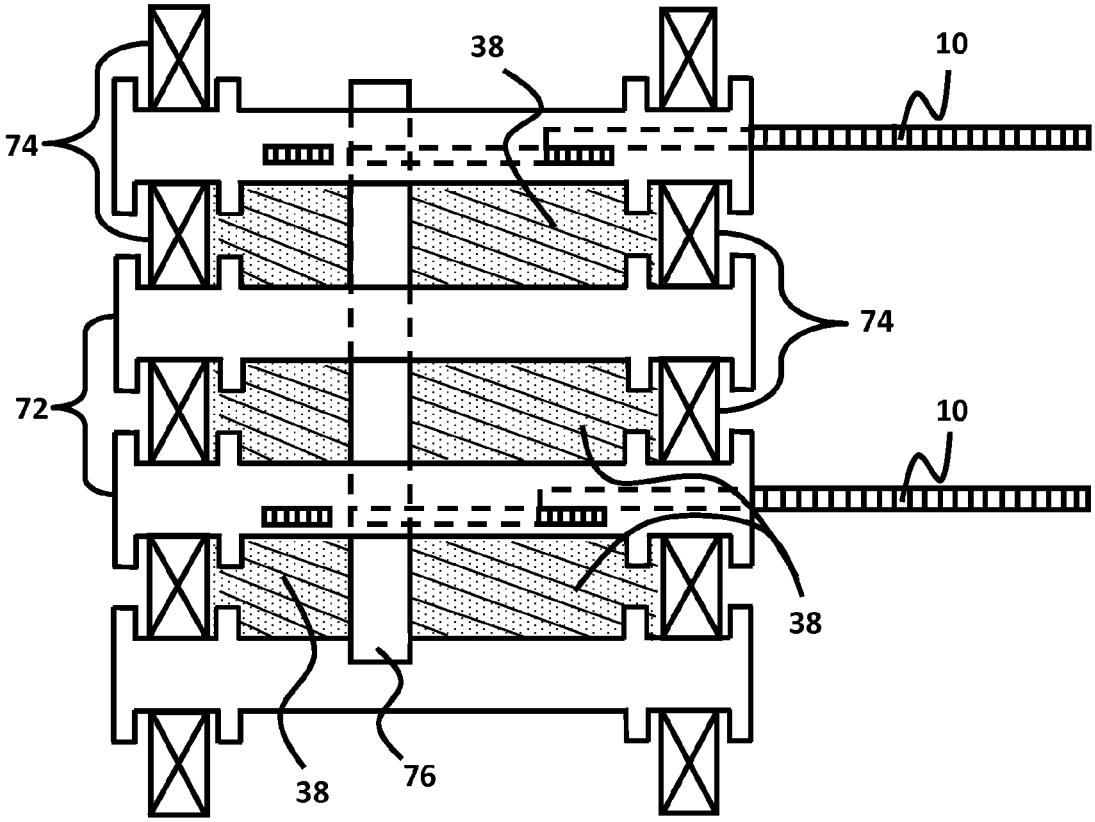
FIG. 15 is a sectional detail of a crib wall facing attached to a tire georeinforcing element showing the buried vertical anchoring element relative to the sidewall of the tire georeinforcing element and the crib wall members.

FIG. 15 is a sectional detail of the crib wall facing 70 from FIG. 14 attached to the tire georeinforcing element. The figure illustrates the buried vertical anchoring element relative to the sidewall of the tire georeinforcing element and the crib wall members.

Figure 16:
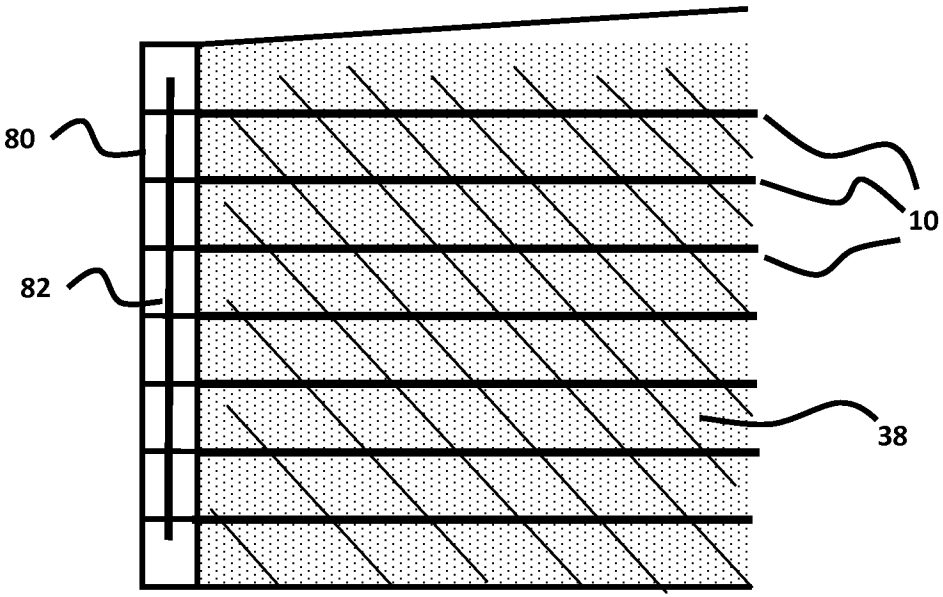
FIG. 16 is a sectional view of a mechanically stabilized embankment utilizing tires stacked vertically or near vertically to form facing elements attached to tire georeinforcing elements by means of vertical bars of any appropriate size and material placed between the tire facing elements and the sidewalls of the tire georeinforcing elements. The tire georeinforcing elements are surrounded by particulate matter; the tire facing elements are backfilled with particulate matter.

A further embodiment of the invention contemplates a tire georeinforcing element of any length which connects to individual tires stacked together as tire facing elements to provide a mechanically stabilized embankment. FIG. 16 is a sectional view of a mechanically stabilized embankment utilizing tires stacked vertically or near vertically to form facing elements attached to tire georeinforcing elements. Vertical bars, of an appropriate size and material, are placed between the tire facing elements and the sidewalls of the tire georeinforcing elements. The tire georeinforcing elements are surrounded by particulate matter and the tire facing elements are backfilled with particulate matter.

Tire facing elements 80 are stacked with each horizontal row offset from the previous row to form a vertical face or a sloping face. The tire sidewall 14 portion of a tire georeinforcing element 10 becomes the free end of the tire georeinforcing element and is placed on a row of tire facing elements 80 so that it straddles the two tire facing elements 80 below. Vertical bars 82 of any appropriate size and material are placed in the small space between the inside edge of the tire sidewall 14 of the tire georeinforcing element 10 and the inside rim of the sidewall of the two tire facing elements 80 below the tire georeinforcing element 10. The tire facing elements 80 are backfilled with particulate matter 38. The zone behind the tire facing elements 80 is backfilled with particulate matter 38 to a distance equal to the lengths of the tire georeinforcing elements 10.

Figure 17:
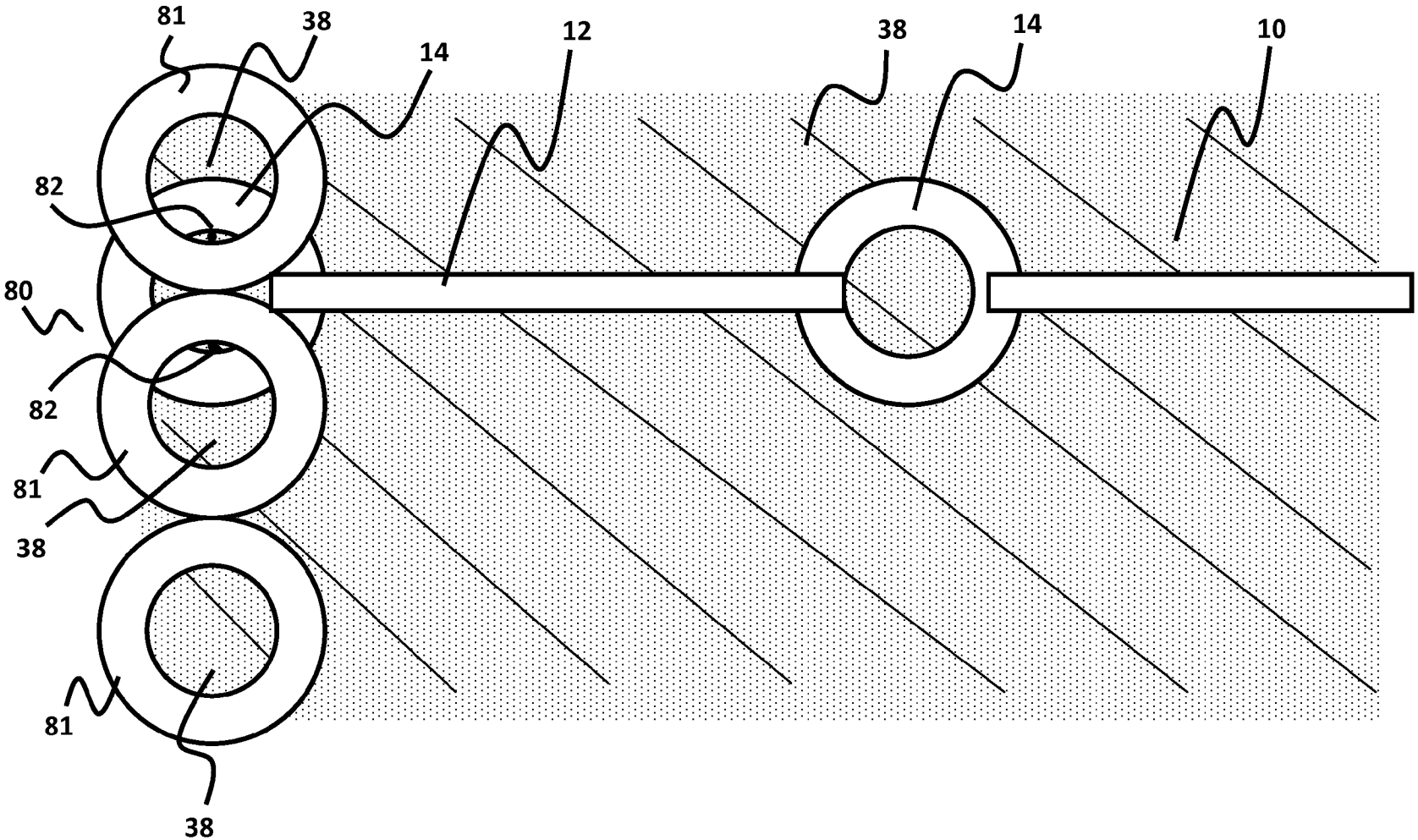
FIG. 17 is a plan view of a tire facing mechanically stabilized embankment demonstrating the placement of the sidewall portion of the tire georeinforcing element between two rows of tire facing elements and securing of the tire georeinforcing elements to the tire facing elements by means of vertical bars.

FIG. 17 is a plan view of a tire facing mechanically stabilized embankment from FIG. 16, demonstrating the placement of the sidewall portion 14 of the tire georeinforcing element 10 between two rows of tire facing elements 81 and securing of the tire georeinforcing elements 10 to the tire facing elements 81 by means of vertical bars 82.

Figure 18:
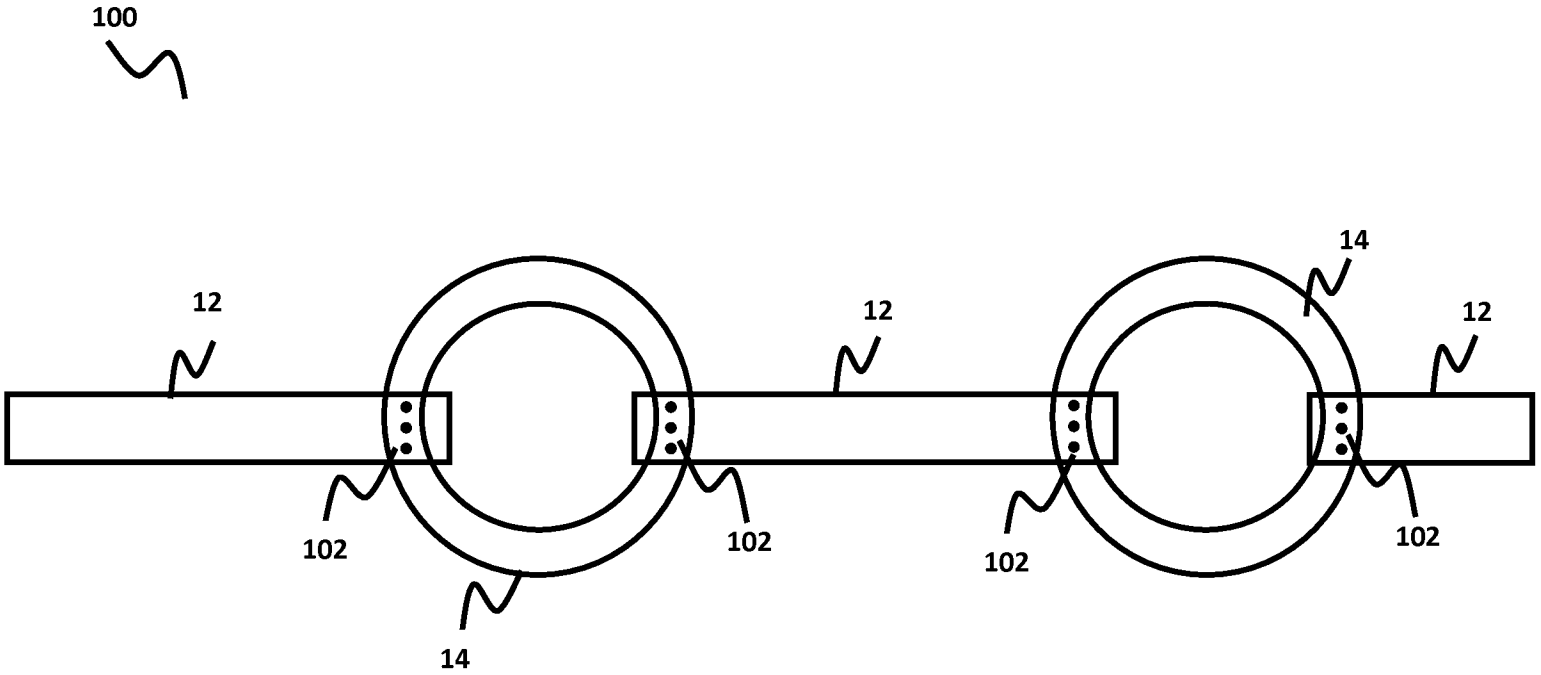
FIG. 18 is a plan view of a tire georeinforcing element consisting of a semi-continuous chain of alternating tire treads and sidewalls fastened together by non-corrosive, non-metallic screws.

Another embodiment of the invention contemplates a tire georeinforcing element 10 of any length comprised of a series of alternating tire treads 12 and sidewalls 14 fastened together by an appropriate number of non-corrosive, non-metallic screws of appropriate size advanced through tire tread 12, through sidewall 14 below and into tread block 20 below sidewall 14. FIG. 18 is a plan view of a tire georeinforcing element 100 consisting of a semi-continuous chain of alternating tire treads 12 and sidewalls 14 fastened together by non-corrosive, non-metallic screws 102. In this embodiment, the tire tread and the tread block 20 are fastened to the sidewall 14, rather than the sidewall 14 resting beneath the tread lip 22 and abutting against the contact surface area of tread block 20.

Figure 19:
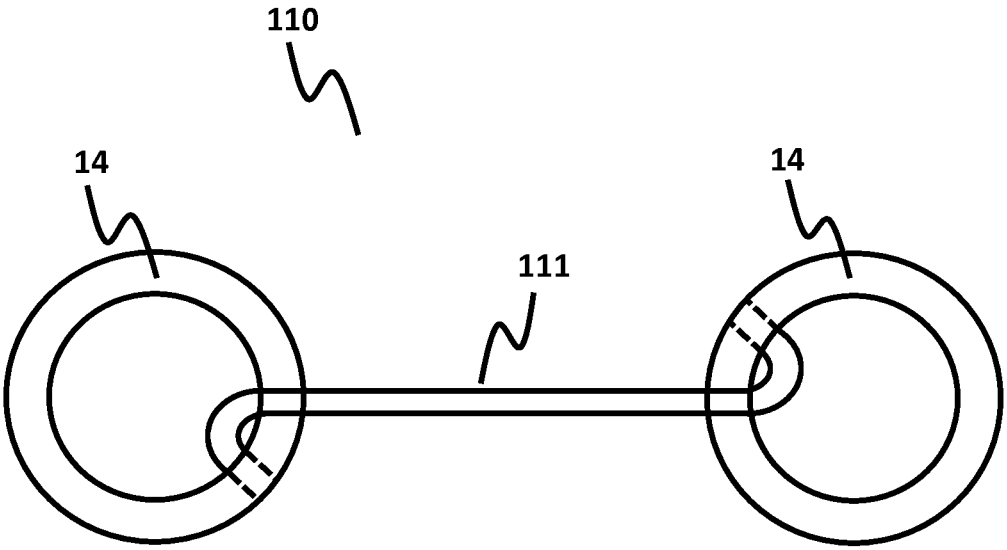
FIG. 19 is a plan view of a partial sidewall georeinforcing element consisting of a semi-continuous chain of alternating tire sidewalls and non-corrosive sidewall attachment hooks.

A further embodiment of the invention contemplates a partial sidewall georeinforcing element of any length consisting of alternating sidewalls and non-corrosive sidewall attachment hooks linked together by placing each end of a sidewall attachment hook in an interior edge of sidewall so that the hook portion extends from each side of the sidewall. FIG. 19 is a plan view of a partial sidewall georeinforcing element 110 consisting of a semi-continuous chain of alternating tire sidewalls 14 and non-corrosive sidewall attachment hooks 111. In alternative embodiments, a metallic or even a corrosive hook can be used.

Figure 20:
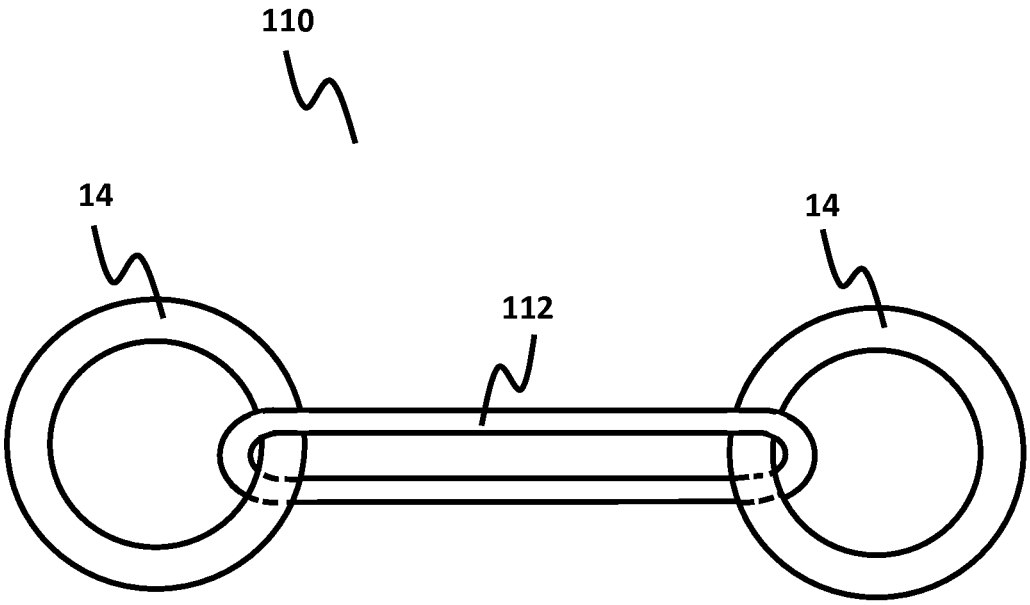
FIG. 20 is a plan view of tire sidewalls connected by a looped non-corrosive cable, chain, rope or strap to form a partial sidewall georeinforcing element.

A still further embodiment of the invention contemplates a partial sidewall georeinforcing element 110 of any length consisting of alternating sidewalls 14 and non-corrosive sidewall connecting device 112. Example sidewall connecting devices include attachment cables, chains, ropes, straps, or other appropriate non-corrosive connecting devices. FIG. 20 is a plan view of tire sidewalls connected by a looped non-corrosive device to form a partial sidewall georeinforcing element.

Figure 21:
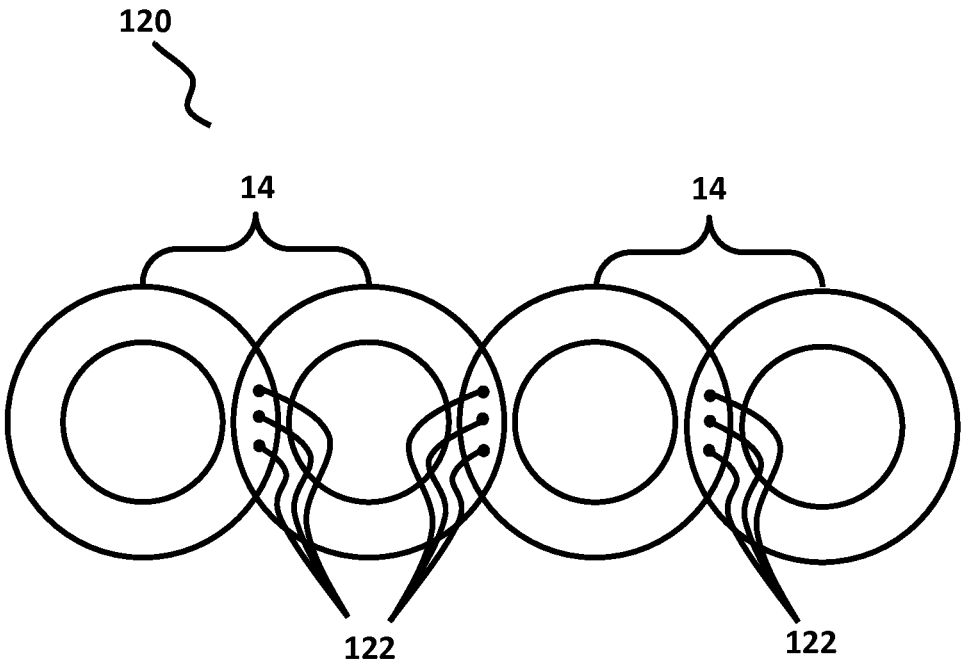
FIG. 21 is a plan view of a sidewall georeinforcing element consisting of a semi-continuous chain of sidewalls fastened together.

Yet another embodiment of the invention contemplates a sidewall georeinforcing element, of any length, comprised of an appropriate number of tire sidewalls overlapped at the edges and fastened together by means of an appropriate number of fastening devices. FIG. 21 is a plan view of a sidewall georeinforcing element 120 consisting of a semi-continuous chain of sidewalls 14 fastened together with fastening devices 122. Examples of fastening devices 122 include bolts, screws, rivets or other appropriate fastening devices to form a sidewall georeinforcing element 120 of any length. Preferable fastening devices are non-metallic and non-corrosive. However, as indicated above, the use of non-metallic and/or non-corrosive fastening devices may not be required in some embodiments. Sidewalls 14 can be cut from tires of different types, such that a first sidewall 14 in the georeinforcing element 120 is from a first type of tire, while a second sidewall 14 is from a second type of tire.

Figure 22:
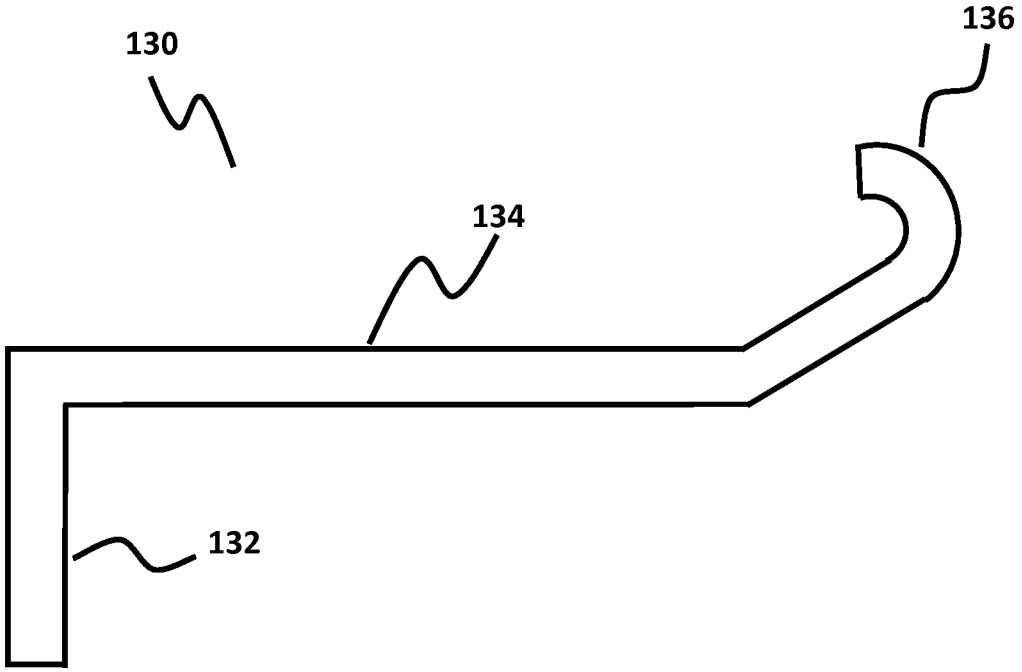
FIG. 22 is a sectional view of a non-corrosive modular block connector piece showing a vertical portion, a horizontal portion and a hook portion.

Still another embodiment of the invention contemplates connecting the tire sidewall 14 of a georeinforcing element to a modular block facing element. For example, a first sidewall 14 of a partial sidewall georeinforcing element or of a sidewall georeinforcing element can be connected to a modular block facing element, such as a solid core modular block facing element 50 or to a hollow core modular block facing element 40. This attachment is effected by using a modular block connector piece 120. FIG. 22 is a sectional view of a non-corrosive modular block connector piece 130 showing a vertical portion 132, a horizontal portion 134, and a hook portion 136. The vertical portion 132 of the non-corrosive modular block connector piece 130 is placed into the core of a modular block facing element, placing the horizontal portion 134 of the non-corrosive modular block connector piece in a pre-manufactured recess 140 in the modular block 30. The first sidewall 14 of the georeinforcing element 138 is placed over the modular block connector piece 130 so that the hook 136 of the modular block connector piece 130 engages the inside rim of the sidewall 14 and pulls the sidewall 14 tight against the hook 136 of the modular block connector piece 130. The georeinforcing element 138 can be a georeinforcing element 10, a georeinforcing element 100, a partial sidewall georeinforcing element, or a sidewall georeinforcing element 120.

Figure 23:
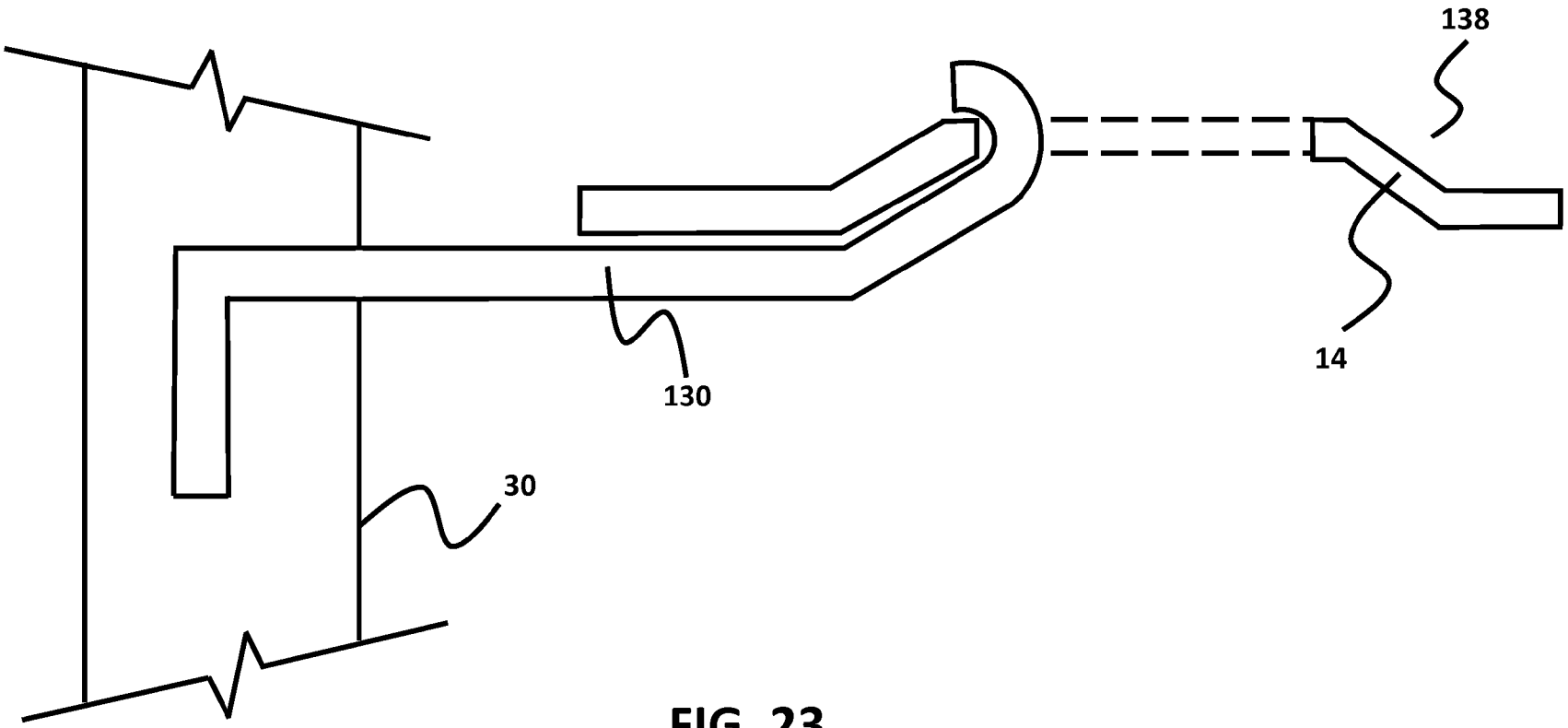
FIG. 23 is a sectional view of a non-corrosive modular block connector piece used to connect a sidewall georeinforcing element to a mechanical stabilized embankment (MSE) facing panel, with the vertical portion of the modular block connector piece embedded in the MSE facing panel.
Figure 24:
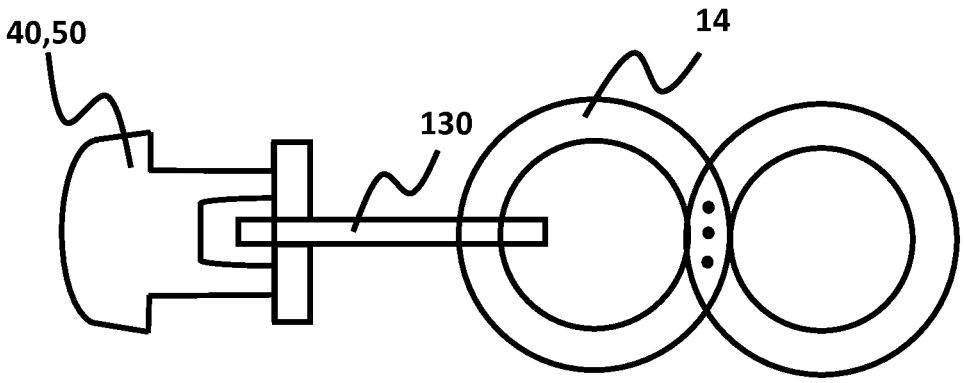
FIG. 24 is a plan view of a modular block, used as a facing element, attached to a sidewall georeinforcing element using a non-corrosive modular block connector.
Figure 25:
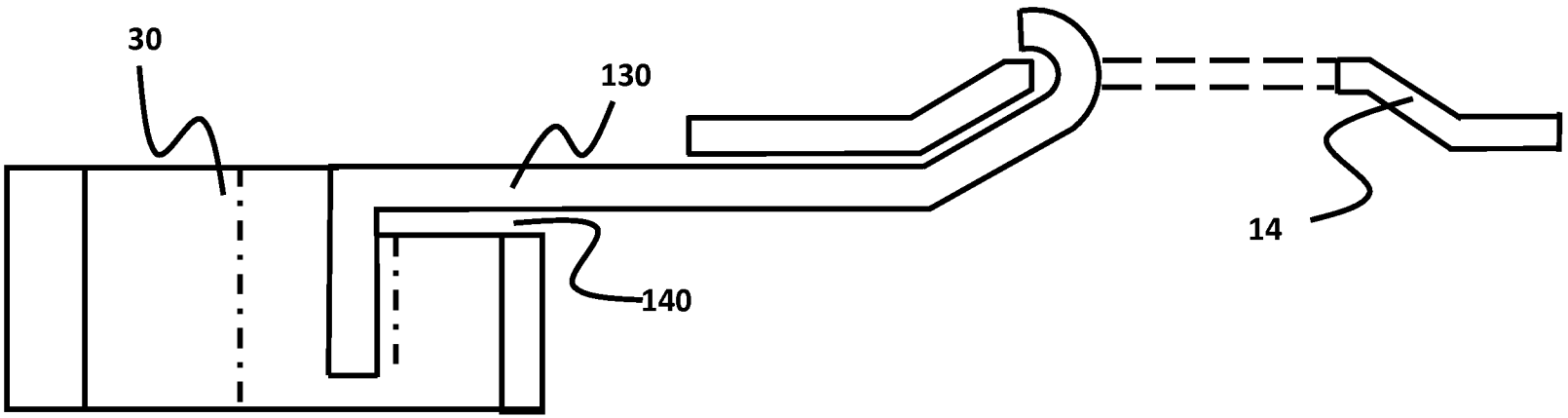
FIG. 25 is a sectional view of a non-corrosive modular block connector piece placed in a modular block and connected to a sidewall georeinforcing element.
Figure 26:
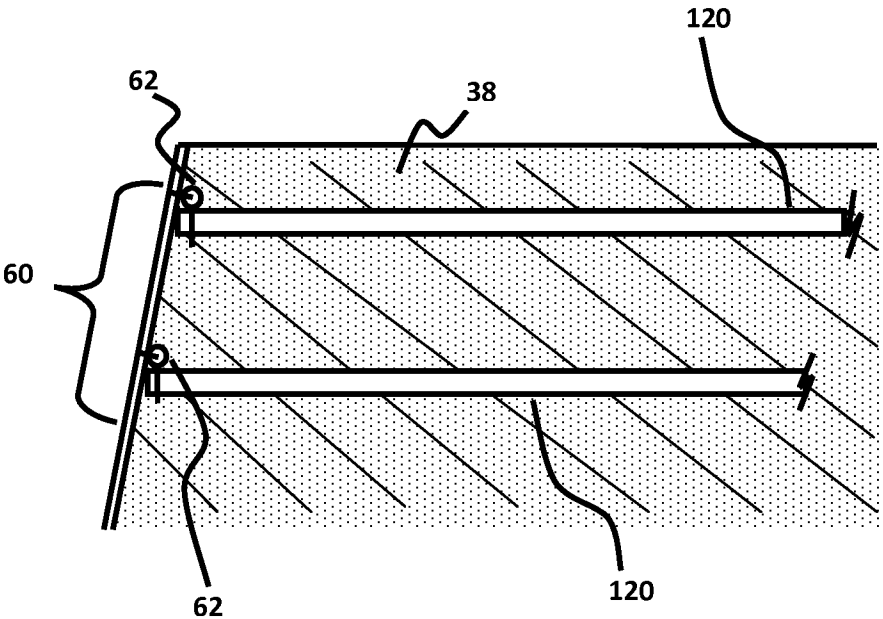
FIG. 26 is a detailed sectional view of a connection between a sidewall georeinforcing element and a reinforced slope face.
Figure 27:
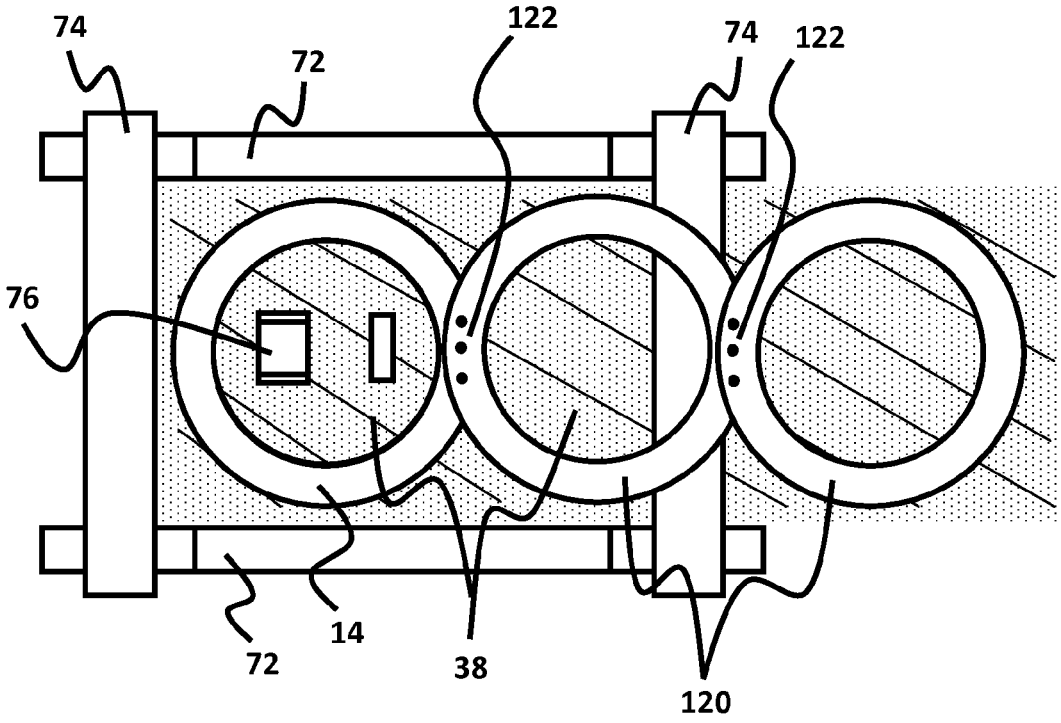
FIG. 27 is a plan view of a crib wall attached to a sidewall georeinforcing element by burying one end of the georeinforcing element in the particulate matter within the crib wall.

A further embodiment of the invention contemplates connecting the first sidewall 14 of a partial sidewall georeinforcing element or a sidewall georeinforcing element to a pre-manufactured facing panel. FIG. 23 is a sectional view of a non-corrosive modular block connector piece 130 used to connect a sidewall georeinforcing element to a mechanical stabilized embankment facing panel 30, with the vertical portion 132 of the modular block connector piece 130 embedded in the MSE facing panel. The vertical portion 132 of the modular block connector piece 130 is completely enveloped in the facing panel 30, with the horizontal portion 134 of the modular block connector piece 130 extending horizontally from the facing panel 30, and the hook 136 on the opposite end of the modular block connector piece 130 engaging the inside rim of the first sidewall 14 of the sidewall georeinforcing element or of the partial sidewall georeinforcing element. The sidewall is pulled tight against the hook 136 of the modular block connector piece 130. FIG. 24 is a plan view of the modular block and the georeinforcement element from FIG. 23, and FIG. 25 is a sectional view of the modular block and the georeinforcement element from FIG. 23.

A still further embodiment of the invention contemplates an embankment constructed of particulate matter 38, with a sloping embankment face, reinforced by means of an appropriate number of sidewall georeinforcing elements 120 or partial sidewall georeinforcing elements 110 placed in the particulate matter and the ends of the same attached to a net or mat 60 of geogrid or other appropriate material. The net or mat 60 covers the sloping face of the particulate matter 38 embankment and is attached to the free ends of the sidewall georeinforcing element 120 or the partial sidewall georeinforcing element 110 by means of non-corrosive hooks 62 of any appropriate size, shape or material advanced through the free ends of each of the sidewall georeinforcing elements 120 or partial sidewall georeinforcing elements 110 and secured by a non-corrosive companion nut.

Another embodiment of the invention contemplates sidewall georeinforcing elements or partial sidewall georeinforcing elements of any length which connect to a crib wall facing to provide a mechanically stabilized embankment. Such an embodiment would be similar to the arrangement illustrated in FIG. 15, but using a sidewall georeinforcing element 120 instead of a georeinforcing element 10. A crib wall facing 70 consists of manufactured headers 72 and stretchers 74 stacked crossways upon each other to form a rectangular box which is filled with particulate matter 38. The first tire sidewall 14 of a sidewall georeinforcing element 120, or of a partial sidewall georeinforcing element, becomes the free end of the georeinforcing element 120 and is placed in the crib wall facing 70 at appropriate regular horizontal and vertical intervals as construction of the crib wall facing 70 progresses. A stretcher 76 is buried in the vertical position in the particulate matter 38 and is positioned such that the inside rim of the first sidewall 14 of the sidewall georeinforcing element 120 engages the vertical buried stretcher 76. The crib wall facing 70 and the georeinforcing element, sidewall or partial, are then backfilled with particulate matter 38.

Figure 28:
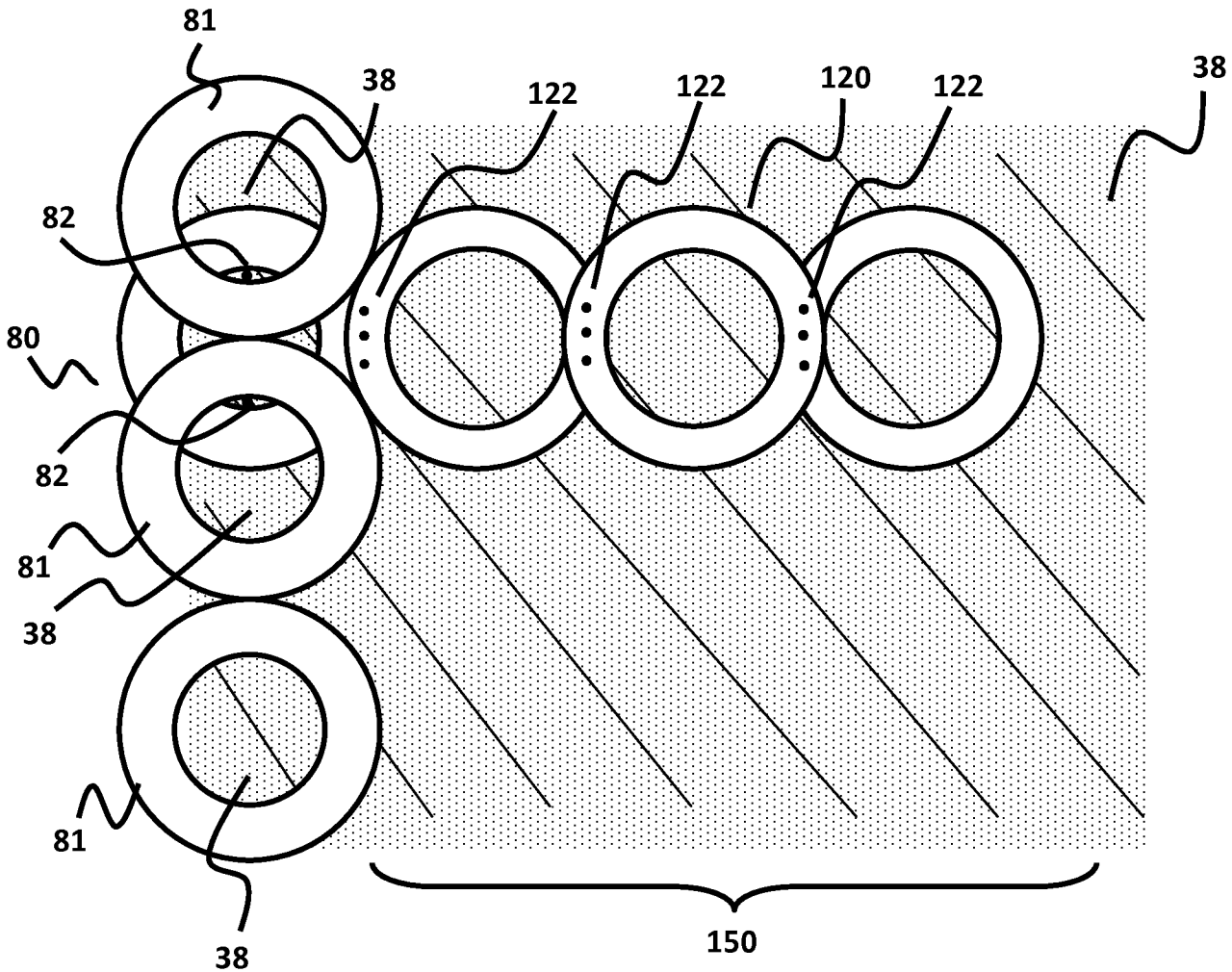
FIG. 28 is a plan view of a tire facing mechanically stabilized embankment demonstrating the placement of the first sidewall of a sidewall georeinforcing element between two rows of tire facing elements.

A further embodiment of the invention contemplates a sidewall georeinforcing element or a partial sidewall georeinforcing element of any length which connects to individual tires stacked together as tire facing elements to provide a mechanically stabilized embankment. FIG. 28 is a plan view of a tire facing mechanically stabilized embankment demonstrating the placement of the first sidewall of a sidewall georeinforcing element between two rows of tire facing elements 80. Tire facing elements 80 are stacked with each horizontal row offset from the previous row to form a vertical face or a sloping face. The first sidewall 14 of a sidewall georeinforcing element 120 becomes the free end of the georeinforcing element and is placed on a row of tire facing elements 80 so that it straddles the two tire facing elements 80 below. Vertical bars 82 of any appropriate size and material are placed in the space between the inside edge of the sidewall 14 of the georeinforcing element and the inside rim of the sidewall of the two tire facing elements 80 below the georeinforcing element. The tire facing elements 80 are backfilled with particulate matter 38. The zone 150 behind the tire facing elements 80 is backfilled with particulate matter 38 to a distance equal to the lengths of the georeinforcing elements.

While the present invention has been illustrated and described herein in terms of a preferred embodiment and several alternatives, it is to be understood that the techniques described herein can have a multitude of additional uses and applications. Accordingly, the invention should not be limited to just the particular description and various drawing figures contained in this specification that merely illustrate a preferred embodiment and application of the principles of the invention.

What is claimed is:

1. A georeinforcing element, comprising:

a first tire tread;

a second tire tread;

a tire sidewall connecting the first tire tread and the second tire tread, a first portion of the tire sidewall attached to the first tire tread, and a second portion of the tire sidewall attached to the second tire tread; and a tire block positioned at an end of the first tire tread, the tire block providing a contact surface area for the first portion of the tire sidewall.

2. The georeinforcing element as recited in claim 1, further comprising a fastening device fastening the tire block to the first tire tread.

3. The georeinforcing element as recited in claim 2, wherein the fastening device includes one or more of a bolt, a screw, or a rivet.

4. The georeinforcing element as recited in claim 2, wherein the fastening device is non-metallic and non-corrosive.

5. The georeinforcing element as recited in claim 1, wherein the tire block includes a lip positioned to project over an edge of the tire block.

6. The georeinforcing element as recited in claim 5, further comprising a fastening device fastening the tire block to the first tire tread.

7. The georeinforcing element as recited in claim 1, wherein the tire block is formed from one or more cut pieces of a tire.

8. The georeinforcing element as recited in claim 7, wherein the one or more cut pieces of tire are formed from a tire sidewall.

9. The georeinforcing element as recited in claim 7, wherein the one or more cut pieces of tire are formed from a combination of tire tread and tire sidewall.

10. The georeinforcing element as recited in claim 7, wherein the one or more cut pieces of tire include a stack of one or more smaller cut pieces and at least one larger cut piece placed on top of the one or more smaller cut pieces, the at least one larger cut piece forming a tire lip.

11. The georeinforcing element as recited in claim 7, wherein the one or more cut pieces of tire are not cut from the first tire tread, the second tire tread, or the tire sidewall.

12. A georeinforcing element, comprising:

a plurality of first tire treads;

a plurality of second tire treads; and a plurality of tire block connectors connecting the plurality of first tire treads and the plurality of second tire treads to form a chain of tire treads, wherein the plurality of tire block connectors are formed from a stack of two or more cut pieces of a tire.

13. The georeinforcing element as recited in claim 12, wherein each tire block connector among the plurality of tire block connectors includes one or more of a bolt, a screw, or a rivet fastening each tire block connector to each tire tread.

14. The georeinforcing element as recited in claim 12, wherein the plurality of tire block connectors are non-metallic and non-corrosive.

15. The georeinforcing element as recited in claim 12, wherein the two or more cut pieces of tire are not cut from the plurality of first tire treads or the plurality of second tire treads.

16. The georeinforcing element as recited in claim 12, wherein the two or more cut pieces of tire are formed from a tire tread.

17. The georeinforcing element as recited in claim 12, wherein the two or more cut pieces of tire are formed from a tire sidewall.

18. The georeinforcing element as recited in claim 12, wherein the two or more cut pieces of tire are formed from a combination of tire tread and tire sidewall.

19. The georeinforcing element as recited in claim 12, wherein the stack of two or more cut pieces of tire includes one or more smaller cut pieces and at least one larger cut piece placed on top of the one or more smaller cut pieces, the at least one larger cut piece forming a tire lip.

20. The georeinforcing element as recited in claim 12, wherein a first tire block connector among the plurality of tire block connectors has a first orientation, wherein a second tire block connector among the plurality of tire block connectors has a second orientation that is opposite the first orientation, and wherein the first tire block connector mates with the second tire block connector.

* * * * *